US007987803B2

(12) United States Patent
Cochran

(10) Patent No.: US 7,987,803 B2
(45) Date of Patent: Aug. 2, 2011

(54) PONTOON BOAT

(76) Inventor: Kenneth Cochran, Plainfield, IN (US)

( * ) Notice: Subject to any disclaimer, the term of this patent is extended or adjusted under 35 U.S.C. 154(b) by 206 days.

(21) Appl. No.: 12/403,475

(22) Filed: Mar. 13, 2009

(65) Prior Publication Data

US 2010/0229775 A1 Sep. 16, 2010

(51) Int. Cl.
*B63B 35/44* (2006.01)

(52) U.S. Cl. ..... 114/258

(58) Field of Classification Search ..... 114/258, 114/248, 362

See application file for complete search history.

(56) References Cited

U.S. PATENT DOCUMENTS 3,815,541 A * 6/1974 Hansen ..... 114/248
5,353,730 A * 10/1994 Talbot ..... 114/248
7,255,057 B2 * 8/2007 Wright ..... 114/362

* cited by examiner

*Primary Examiner* — Stephen Avila
(74) *Attorney, Agent, or Firm* — Jerry D. Haynes; Law Office of Jerry D. Haynes

(57) ABSTRACT

Disclosed is a pontoon boat. The pontoon boat includes a deck, a pair of pontoons, an elongated channel member and a boat. The pair of pontoons is disposed on a water side portion of the deck for supporting the deck above a water level. The elongated channel member is disposed on the water side portion of the deck between the pair of pontoons. The elongated channel member is configured to have longitudinal sliding movement with respect to the water side portion of the deck. The boat includes a body portion and a pair of lip portions. The pair of lip portions is configured to be slidingly received in the elongated channel member for removably securing the boat to the water side portion of the deck.

3 Claims, 4 Drawing Sheets

PONTOON BOAT

FIELD OF THE INVENTION

The present invention generally relates to a watercraft, and, more particularly, to a pontoon boat.

BACKGROUND OF THE INVENTION

A watercraft refers to a vehicle, a vessel or a craft, designed to move across or through water. The term, 'water' may refer to seawater, river water and the like. Suitable examples of the watercraft may include, but are not limited to, a ship and a boat. A boat may be configured to be small in size and is configured to move across or through rivers, lakes and such other water bodies. A typical example of the boat may be a pontoon boat, which is configured to move across or through various rivers, lakes and such other water bodies.

A pontoon boat is a flat-bottomed boat configured to support a structure above the water. The term 'structure' may refer to a simple platform similar to a raft, a house-like structure similar to a houseboat, and the like. The pontoon boat includes a deck and at least one pontoon. The deck is a flat structure and includes a water side portion and a payload side portion. The at least one pontoon is disposed on the water side portion of the deck, and more specifically, on longitudinal edge portions of the water side portion. The at least one pontoon is configured to support the deck above a water level. Further, the at least one pontoon may be constructed from closed cylinders such as pipes and barrels. Alternately, the at least one pontoon may be fabricated in the form of boxes made of materials, such as metal and concrete. Further, the pontoon boat may be propelled by various means, such as an oar and an internal combustion engine.

However, currently existing pontoon boats are usually incapable of easily navigating across or through high, rough or choppy water of lakes, rivers and such other water bodies. Further, the currently existing pontoon boats are incapable of exhibiting sufficiently high buoyancy, and accordingly, may face problems while changing respective directions, as and when desired.

Accordingly, there exists a need for a pontoon boat that is capable of being easily navigated across or through high, rough or choppy water of lakes, rivers and such other water bodies. Further, there is a need for a pontoon boat that is capable of easily changing a direction thereof, as and when desired.

SUMMARY OF THE INVENTION

In view of the foregoing disadvantages inherent in the prior art, the general purpose of the present invention is to provide a pontoon boat that is configured to include all the advantages of the prior art, and to overcome the drawbacks inherent therein.

Accordingly, an object of the present invention is to provide a pontoon boat that is capable of being easily navigated across or through high, rough or choppy water of lakes, rivers and such other water bodies.

Another object of the present invention is to provide a pontoon boat that is capable of easily changing a direction thereof, as and when desired.

In light of the above objects, a pontoon boat is disclosed. The pontoon boat includes a deck, a pair of pontoons, an elongated channel member and a boat. The deck includes a water side portion. The pair of pontoons is disposed on the water side portion of the deck for supporting the deck above a water level. The elongated channel member is disposed on the water side portion of the deck between the pair of pontoons. The elongated channel member is configured to have longitudinal sliding movement with respect to the water side portion of the deck. The boat includes a body portion and a pair of lip portions. The body portion includes a pair of upper longitudinal edge portions. Each of the pair of lip portions is configured to be extending from one of the pair of upper longitudinal edge portions of the body portion. The pair of lip portions is configured to be slidingly received in the elongated channel member for removably securing the boat to the water side portion of the deck.

This aspect together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular pontoon boat, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a pontoon boat, which is stable and has sufficiently high buoyancy, and is capable of being easily navigated across or through high, rough or choppy water of lakes, rivers and such other water bodies. Further, the pontoon boat is capable of easily changing a direction thereof as and when desired. The pontoon boat includes a deck, a pair of pontoons disposed on a water side portion of the deck, an elongated guide member, an elongated channel member disposed on the water side portion of the deck between the pair of pontoons and an additional boat slidingly received in the elongated channel member for being removably secured to the water side portion of the deck. The pontoon boat of the present invention is explained in conjunction with FIGS. 1, 2A, 2B, 3, and 4.

Figure 1:
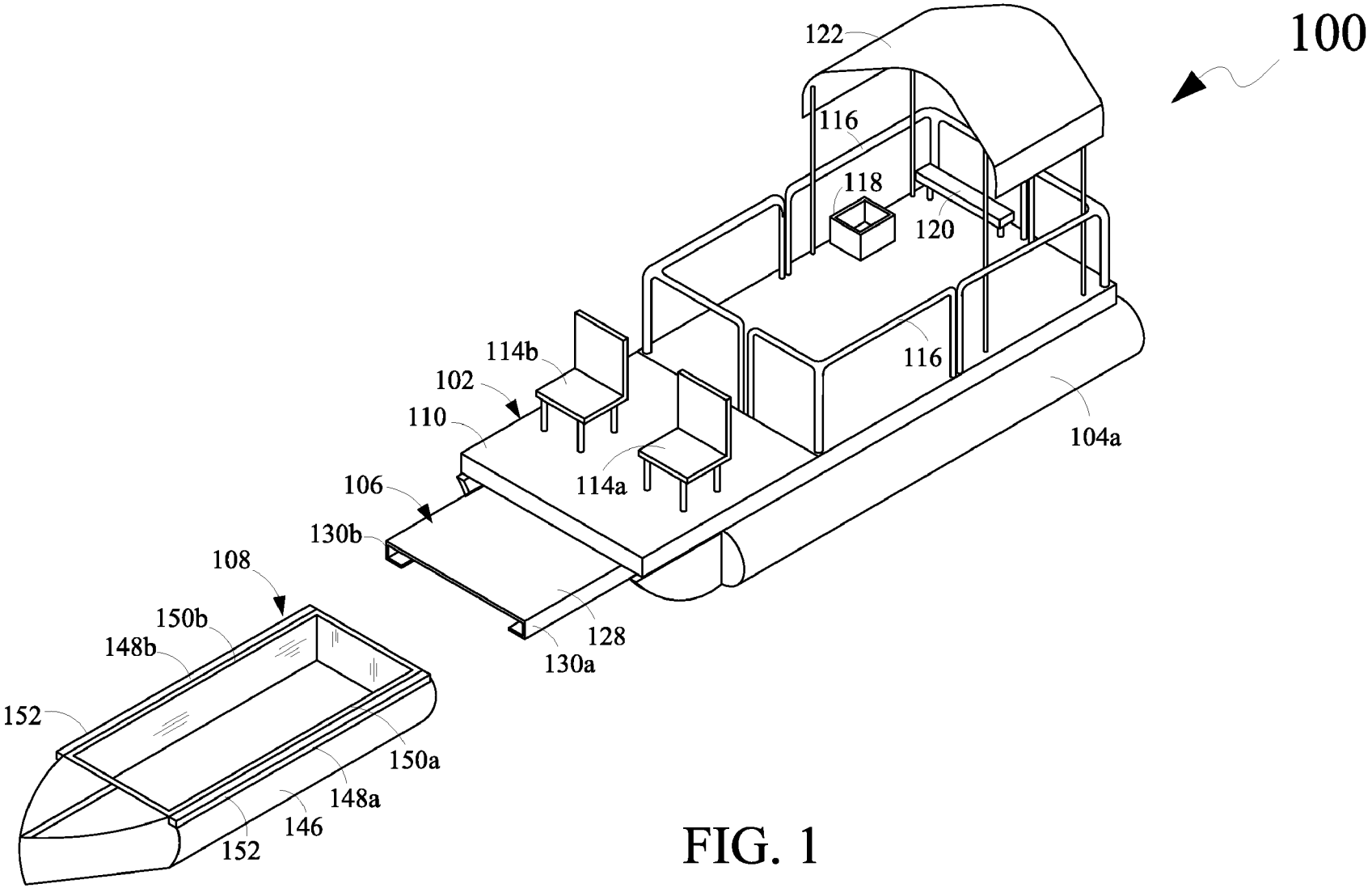
FIG. 1 illustrates an exploded view of a pontoon boat, in accordance with an embodiment of the present invention.

Referring to FIG. 1, FIG. 2A, FIG. 2B, FIG. 3, and FIG. 4, a pontoon boat 100 is illustrated. More specifically, FIG. 1 illustrates an exploded view of the pontoon boat 100, in accordance with an embodiment of the present invention. The pontoon boat 100 includes a deck 102; a pair of pontoons, such as a pontoon 104*a* and a pontoon 104*b* (hereinafter collectively referred to as "pair of pontoons 104"); an elongated channel member 106; and a boat 108.

Figure 3:
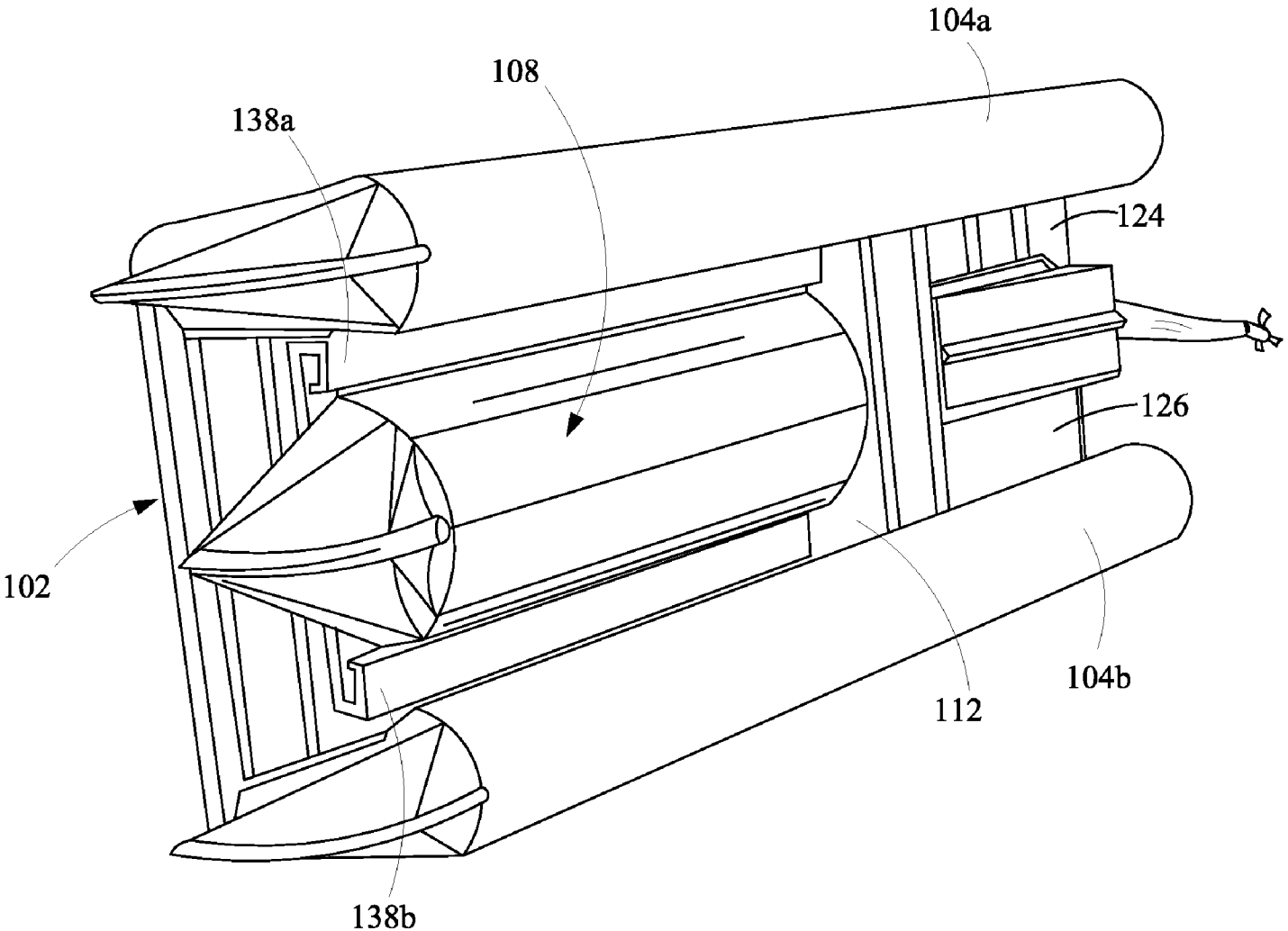
FIG. 3 illustrates a perspective view of a boat removably secured to a water side portion of a deck of the pontoon boat of FIG. 1, in accordance with an embodiment of the present invention.
Figure 4:
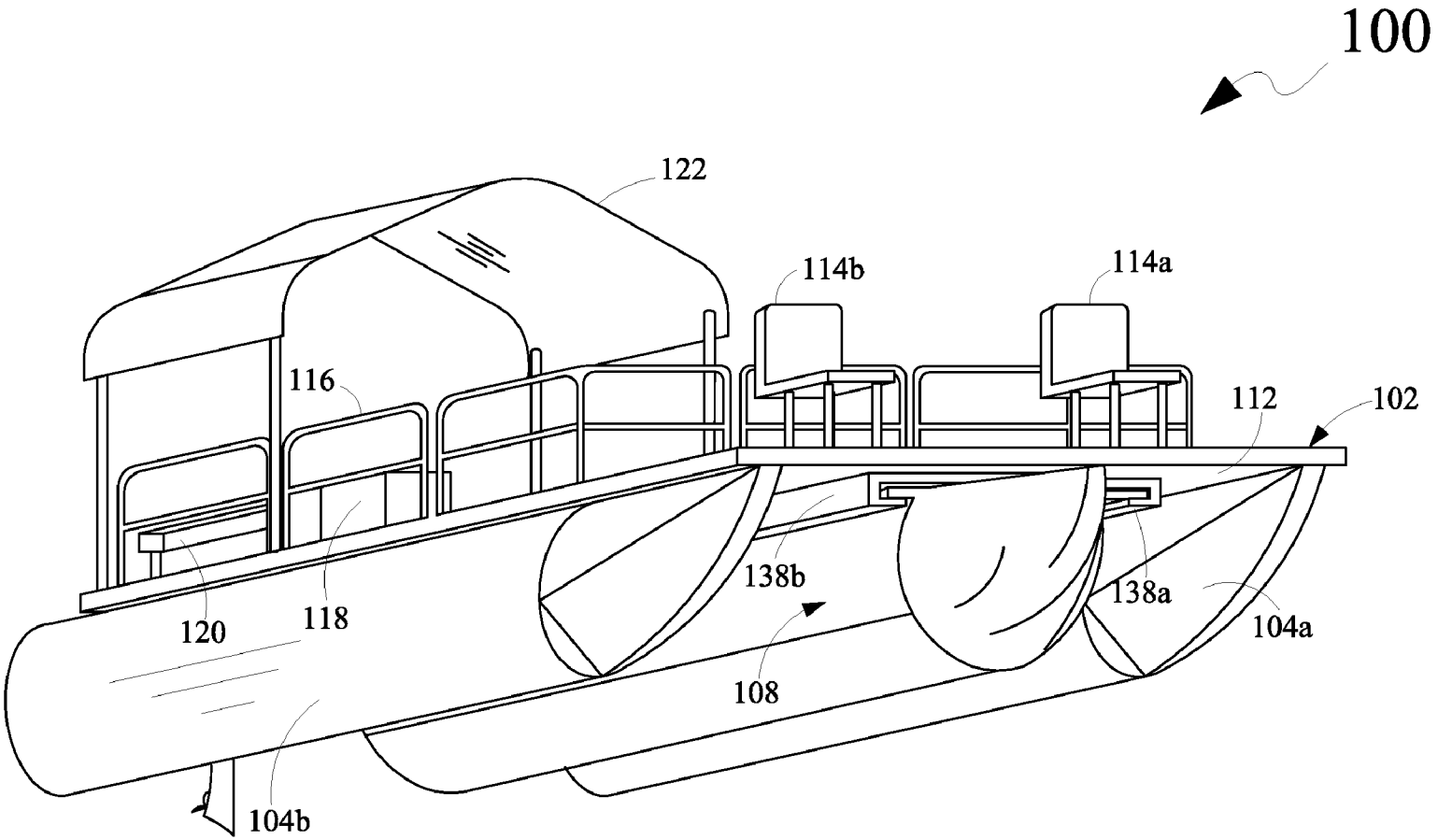
FIG. 4 illustrates a bottom perspective view of the pontoon boat of FIG. 1, in accordance with an embodiment of the present invention.

The deck 102 includes a payload side portion 110 and a water side portion 112 (as shown in FIG. 3 and FIG. 4). The payload side portion 110 is adapted to carry passengers and/or cargo. More specifically, the payload side portion 110 may be provided with a pair of chairs, such as a chair 114*a* and a chair 114*b* (hereinafter collectively referred to as "pair of chairs 114"), a plurality of safety railings 116, a storage container 118, a bench 120 and a shade assembly 122. The pair of chairs 114, the plurality of safety railings 116, the storage container 118, the bench 120 and the shade assembly 122 are disposed on the payload side portion 110 of the deck 102. The pair of chairs 114 and the bench 120 are configured to provide seating arrangement for the passengers of the pontoon boat 100. The plurality of safety railings 116 is configured to act as a barrier between the passengers of the pontoon boat 100, and water of river, lake and such other water bodies. The storage container 118 is configured to store various items for the passengers. The shade assembly 122 is configured to provide covering for protecting the passengers seated on the bench 120 from direct sunlight, rainfall or such other adverse climatic conditions. It should be apparent to a person skilled in the art that the payload side portion 110 may be provided with various other items, and the use of the pair of chairs 114, the plurality of safety railings 116, the storage container 118, the bench 120, and the shade assembly 122 should not be construed as a limitation of the present embodiment of the present invention.

The pair of pontoons 104 is disposed on the water side portion 112 of the deck 102. More specifically, the pontoon 104*a* is disposed adjacent to a first side portion 124 (as shown in FIG. 3) of the water side portion 112 and the pontoon 104*b* (as shown in FIG. 3 and FIG. 4) is disposed adjacent to a second side portion 126 (as shown in FIG. 3) of the water side portion 112. The pair of pontoons 104 is configured to support the deck 102 above a water level of the river, lake or such other water bodies. More particularly, the pair of pontoons 104 is configured to provide buoyancy to the pontoon boat 100. The pair of pontoons 104 may be constructed from closed cylinders such as pipes or barrels. Alternately, the pair of pontoons 104 may be fabricated in the form of boxes. Further, the pair of pontoons 104 may be composed of at least one of aluminum, polystyrene, fiberglass, metal, and concrete. Alternately, the pair of pontoons 104 may be composed of various inflatable materials, such as rubber, that are capable providing buoyancy to the pontoon boat 100. It should be understood that the pair of pontoons 104 may be made of any other material known in the art. The pair of pontoons 104 is configured to be durable, easy to store and light in weight.

It should be understood that the pair of pontoons 104 may be disposed on the water side portion 112 of the deck 102 by various means known in the art. For example, in one embodiment of the present invention, the pair of pontoons 104 may be secured to the water side portion 112 of the deck 102 by means of a plurality of adjustable straps. Accordingly, the water side portion 112 of the deck 102 is configured to removably secure the pair of pontoons 104 thereto. Alternately, the pair of pontoons 104 may be secured to the water side portion 112 of the deck 102 by various other suitable means such as nuts and bolts, welding and the like.

Figures 2A, 2B:
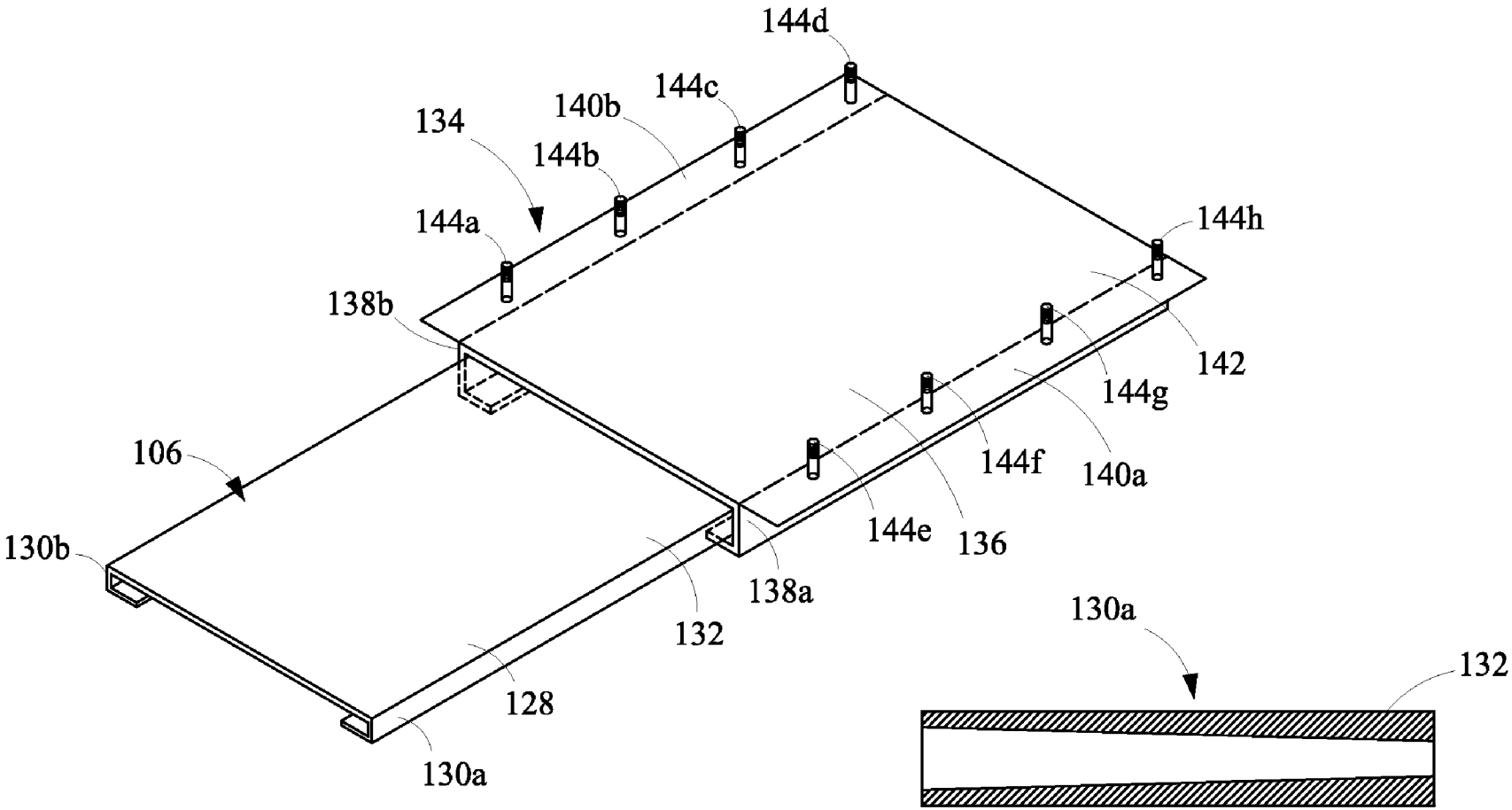
FIG. 2A illustrates a perspective view of an elongated guide member configured for facilitating longitudinal sliding movement of an elongated channel member with respect to a water side portion of a deck of the pontoon boat of FIG. 1, in accordance with an embodiment of the present invention.
FIG. 2B illustrates a sectional view of an elongated channel of the elongated channel member shown in FIG. 2A, in accordance with an embodiment of the present invention.

The elongated channel member 106 is disposed on the water side portion 112 of the deck 102 between the pair of pontoons 104. The elongated channel member 106 includes a horizontal body portion 128 and a pair of elongated channels, such as an elongated channel 130*a* and an elongated channel 130*b* (hereinafter collectively referred to as "pair of elongated channels 130"), extending from a pair of longitudinal edge portions (not numbered) of the horizontal body portion 128. In the present embodiment of the present invention, each of the pair of elongated channels 130 is configured to shrink at a distal end portion. For example, the elongated channel 130*a* is configured to shrink at a distal end portion 132 thereof (as shown in FIG. 2B). Further, the each of the pair of elongated channels 130 may be configured to shrink by 0.5 millimeter (mm) at the distal end portion thereof. Although, in the present embodiment of the present invention, the each of the pair of elongated channels 130 may be configured to shrink by 0.5 mm, the present invention is not limited to any particular dimension.

The each of the pair of elongated channels 130 is configured to shrink at the distal end portion thereof in a manner such that a passage (not numbered) configured within the each of the pair of elongated channels 130 shrinks along a length thereof. It should be evident that the pair of elongated channels 130 may be designed to have shrunk distal end portions. Such design of the pair of elongated channels 130 may be achieved during manufacturing by material reinforcement techniques. Alternatively, the pair of elongated channels 130 may be designed in the form of tapered channels.

With the help of the pair of elongated channels 130, the elongated channel member 106 is configured to have longitudinal sliding movement with respect to the water side portion 112 of the deck 102.

In one embodiment of the present invention, an elongated guide member 134 (shown in FIG. 2A) is configured for facilitating the longitudinal sliding movement of the elongated channel member 106 with respect to the water side portion 112 of the deck 102. The elongated guide member 134 includes a horizontal body portion 136; a pair of elongated channels, such as an elongated channel 138*a* and an elongated channel 138*b* (hereinafter collectively referred to as "pair of elongated channels 138"); and a pair of lip portions, such as a lip portion 140*a* and a lip portion 140*b* (hereinafter collectively referred to as "pair of lip portions 140"). Each of the pair of elongated channels 138 is extending from one of a pair of longitudinal edge portions (not numbered) of the horizontal body portion 136. Further, in one embodiment of the present invention, the each of the pair of elongated channels 138 is configured to shrink at a distal end portion thereof. For example, the elongated channel 138*a* is configured to shrink at a distal end portion 142, in a similar manner as shown in conjunction with FIG. 2B. Furthermore, the each of the pair of elongated channels 138 may be configured to shrink by 0.5 mm at the distal end portion thereof. Although, in the present embodiment of the present invention, the each of the pair of elongated channels 138 is configured to shrink by 0.5 mm, the present invention is not limited to any particular dimension.

The each of the pair of elongated channels 138 is configured to shrink at the distal end portion thereof in a manner such that a passage (not numbered) configured within the each of the pair of elongated channels 138 shrinks along a length thereof. It should be evident that the pair of elongated channels 138 may be designed to have shrunk distal end portions. Such design of the pair of elongated channels 138 may be achieved during manufacturing by material reinforcement techniques. Alternatively, the pair of elongated channels 138 may be designed in the form of tapered channels.

Further, each of the pair of lip portions 140 is configured to be extending horizontally from one of the pair of longitudinal edge portions of the horizontal body portion 136.

The elongated guide member 134 is configured to be removably secured to the water side portion 112 of the deck 102 by means of a plurality of bolts, such as a bolt 144*a*, a bolt 144*b*, a bolt 144*c*, a bolt 144*d*, a bolt 144*e*, a bolt 144*f*, a bolt 144*g*, and a bolt 144*h* (hereinafter collectively referred to as "plurality of bolts 144"). The plurality of bolts 144 may be disposed on the pair of lip portions 140. Although, in the present embodiment of the present invention, the elongated guide member 134 may be removably secured to the water side portion 112 of the deck 102 by means of the plurality of bolts 144, the present invention is not limited to the plurality of bolts 144. Accordingly, various other fasteners, such as screws and rivets, may be used for securing the elongated guide member 134 to the water side portion 112 of the deck 102. Alternatively, the elongated guide member 134 may be permanently secured to the water side portion 112 of the deck 102 by means of various welding mechanisms known to the person skilled in the art.

Further, the elongated channel member 106 is configured to be slidingly received in the elongated guide member 134, such that the elongated guide member 134 enables the elongated channel member 106 to be disposed on the water side portion 112 of the deck 102 between the pair of pontoons 104. More specifically, the pair of elongated channels 130 is configured to be slidingly received in the pair of elongated channels 138. The pair of elongated channels 130 may be locked in the pair of elongated channels 138 after the pair of elongated channels 130 snugly fit within the shrunk distal end portions of the pair of elongated channels 138. Accordingly, the elongated channel member 106 is configured to removably secure the boat 108 to the water side portion 112 of the deck 102.

The boat 108 includes a body portion 146; and a pair of lip portions, such as a lip portion 148*a*, a lip portion 148*b* (hereinafter collectively referred to as "pair of lip portions 148"). The body portion 146 includes a pair of upper longitudinal edge portions, such as an upper longitudinal edge portion 150*a* and an upper longitudinal edge portion 150*b* (hereinafter collectively referred to as "pair of upper longitudinal edge portions 150"). The pair of lip portions 148 is configured to be extending from the pair of upper longitudinal edge portions 150. More specifically, the lip portion 148*a* is configured to be extending from the upper longitudinal edge portion 150*a* and the lip portion 148*b* is configured to be extending from the upper longitudinal edge portion 150*b*. Further, as shown in FIG. 1, the pair of lip portions 148 may be horizontally extending from the upper longitudinal edge portion 150*a* and the upper longitudinal edge portion 150*b*. Furthermore, in another embodiment of the present invention, the pair of lip portions 148 may be arcuately extending from the upper longitudinal edge portion 150*a* and the upper longitudinal edge portion 150*b*. Accordingly, the present invention is not limited to the manner of extension of the pair of lip portions 148 from the pair of longitudinal edge portions 150. Further, each of the pair of lip portions 148 includes an edge portion 152.

The pair of lip portions 148 is configured to be slidingly received in the elongated channel member 106 for securing the boat 108 to the water side portion 112 of the deck 102. More specifically, the lip portion 148*a* is configured to be received in the elongated channel 130*a* and the lip portion 148*b* is configured to be received in the elongated channel 130*b*. Moreover, the boat 108 may be secured to the water side portion 112 of the deck 102 by means of locking of the pair of lip portions 148 in the shrunk distal end portions of the pair of elongated channels 130. Further, in one embodiment of the present invention, the boat 108 may be additionally secured by means of a pin to the water side portion 112 of the deck 102, when the pontoon boat 100 is propelled by an engine powered by one of various means such as electricity, gas, and like.

Further, the pair of lip portions 148 of the boat 108 and the pair of elongated channels 130 of the elongated channel member 106 are configured to facilitate longitudinal movement of the boat 108 with respect to the elongated channel member 106 while preventing the lateral movement of the boat 108 with respect to the elongated channel member 106. Further, the pair of lip portions 148 of the boat 108 and the pair of elongated channels 130 of the elongated channel member 106 may be configured complementary to each other, using various means and methods known to a person having ordinary skill in the art.

In one embodiment of the present invention, the pontoon boat 100 may include a locking mechanism for securely retaining the pair of lip portions 148 in the pair of elongated channels 130 of the elongated channel member 106 in order to prevent any unintentional longitudinal movement of the pair of lip portions 148 of the boat 108 with respect to the pair of elongated channels 130.

The boat 108 in secured position with the elongated channel member 106 (shown in FIG. 4) is configured to act similar to a hull of a ship. Further, in the secured position with the elongated channel member 106, the boat 108 is configured to act as a third pontoon. Furthermore, the boat 108 is configured to provide more stability, buoyancy and lift to the pontoon boat 100, during navigation of the pontoon boat 100 across or through high, rough or choppy water of lakes, rivers and such other water bodies. Moreover, due to additional stability, buoyancy and lift provided by the boat 108, the pontoon boat 100 is capable of easily changing a direction thereof, as and when desired.

Further, the boat 108 is configured to be slid out of the elongated channel member 106, as per a user's requirement. Accordingly, the boat 108 may also be used as an independent boat, as a fishing boat or a supply boat. The boat 108 may be configured to facilitate various activities, such as fishing, and supplying goods and materials to other ships/boats. Therefore, the boat 108 may be configured to accommodate one or more individuals. Further, the boat 108 may be capable of accommodating a plurality of goods and materials. In one embodiment of the present invention, the boat 108 may be configured to have a length ranging from about nine feet to about fourteen feet. Furthermore, in one embodiment of the present invention, the body portion 146 of the boat 108 may be manufactured to have width larger than that of the elongated channel member 106 in order to occupy entire space between the pair of pontoons 104.

The pontoon boat 100 may be propelled by various means known to a person having ordinary skill in the art. In one embodiment of the present invention, the pontoon boat 100 may be propelled by a jet drive device. In another embodiment of the present invention, the pontoon boat 100 may be propelled by at least one oar. In yet another embodiment of the present invention, the pontoon boat 100 may be propelled by an internal combustion engine. Further, in another embodiment of the present invention, the pontoon boat 100 may be propelled by an electric trolling motor.

Various embodiments of the present invention offer the following advantages. The pontoon boat, such as the pontoon boat 100, as described herein, is capable of being easily navigated in high, rough or choppy water of lakes, rivers and such other water bodies. Further, the pontoon boat is configured to easily change a direction thereof, as and when desired. Furthermore, the pontoon boat is simple in construction and easy to use.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A pontoon boat comprising:

a deck comprising a water side portion:

a pair of pontoons disposed on the water side portion of the deck for supporting the deck above a water level:

an elongated channel member disposed on the water side portion of the deck between the pair of pontoons, the elongated channel member confirmed to have longitudinal sliding movement with respect to the water side portion of the deck, where the elongated channel member further comprises a horizontal body portion and a pair of elongated channels extending from the horizontal body portion, where the elongated channels are configured to shrink at the distal end portion; and a boat comprising, a body portion, the body portion comprising a pair of upper longitudinal edge portions, and a pair of lip portions, each of the pair of lip portions configured to be extending from one of the pair of upper longitudinal edge portions of the body portion, the pair of lip portions configured to be slidingly received in the elongated channel member for removably securing the boat to the water side portion of the deck.

2. The pontoon boat of claim 1, wherein the pair of pontoons is composed of at least one of aluminum, polystyrene, fiberglass, metal, and concrete.

3. The pontoon boat of claim 1 further comprising an elongated guide member removably secured to the water side portion of the deck, the elongated guide member capable of slidingly receiving the elongated channel member and capable of facilitating longitudinal sliding movement of the elongated channel member with respect to the water side portion of the deck.

* * * * *